United States Patent [19]

Pratley

[11] Patent Number: 4,486,168

[45] Date of Patent: Dec. 4, 1984

[54] FLARE

[75] Inventor: Gerald Pratley, Hampton, England

[73] Assignee: The British Petroleum Company p.l.c., London, England

[21] Appl. No.: 388,685

[22] Filed: Jun. 15, 1982

[30] Foreign Application Priority Data

Jun. 20, 1981 [GB] United Kingdom ..... 8119096

[51] Int. Cl.[3] ..... F23D 13/20

[52] U.S. Cl. ..... 431/202; 431/284

[58] Field of Search ..... 431/5, 202, 278, 284, 431/285

[56] References Cited

U.S. PATENT DOCUMENTS 3,824,073 7/1974 Straitz ..... 431/284

4,084,935 4/1978 Reed et al. ..... 431/202

FOREIGN PATENT DOCUMENTS 026067 4/1981 European Pat. Off. .

2007830 5/1979 United Kingdom .

*Primary Examiner*—Margaret A. Focarino

*Attorney, Agent, or Firm*—Morgan, Finnegan, Pine, Foley & Lee

[57] ABSTRACT

A flare tip has an inner tube having an inlet and outlet for an air supply and an outer co-axial tube spaced apart from the inner tube to form an annular gap. The annular gap has an inlet for a fuel gas supply and the upper part of the inner tube has a plurality of channels. The channels are shaped to encourage upward and inward flow of fuel gas so as to mix with air issuing from the outlet of the inner tube.

3 Claims, 3 Drawing Figures

FLARE

The present invention relates to flares and more particularly to flares having reduced smoke emission.

Numerous types of flare have been used for the disposal of combustible gases from refineries, petrochemical plant and offshore installations. When using simple pipe flares, it is often found that unacceptable levels of smoke emission and radiation are encountered. This may be overcome by, for example, injection of a smoke suppressant, e.g. steam, into the fuel gases or alternatively by use of a flare of the Coanda type, e.g. GB Pat. No. 1,383,867, in which a high pressure medium, e.g. steam, inspirates additional air into the fuel gas. However, these techniques involve more complexity and usually more expense.

The present invention is directed towards a flare having improved smoke suppressant characteristics.

Thus, according to the present invention, there is provided a flare tip comprising an inner tube having an inlet and outlet for an air supply, an outer co-axial tube spaced apart from the inner tube to form an annular gap, the annular gap having an inlet for a fuel gas supply, the upper part of the inner tube having a plurality of channels, the channels being adapted to encourage upward and inward flow of fuel gas so as to mix with air issuing from the outlet of the inner tube.

The flare tip may form an integral part of a flare or alternatively may be a separate unit capable of being fitted to a flare.

The shape of the channels or intrusions are preferably aerodynamically contoured to give minimum resistance to the upward and inward gas flow. Preferably the channels or intrusions comprise a plurality of equally spaced hollow wedge-shaped projections from the inner surface of the inner tube. Also the channels or intrusions may have U-shaped or curved sections to give improved aerodynamic flow.

Preferably the total cross-sectional area of the fuel gas channel or intrusion outlets is greater than or equal to the total cross-sectional area of the annular fuel gas outlet.

The air is supplied from a pressurised source such as compressors or fans.

The flare is preferably equipped with a pilot light for ignition purposes.

The invention will now be described by way of example only with reference to FIGS. 1 to 3 of the accompanying drawings.

Figure 1:
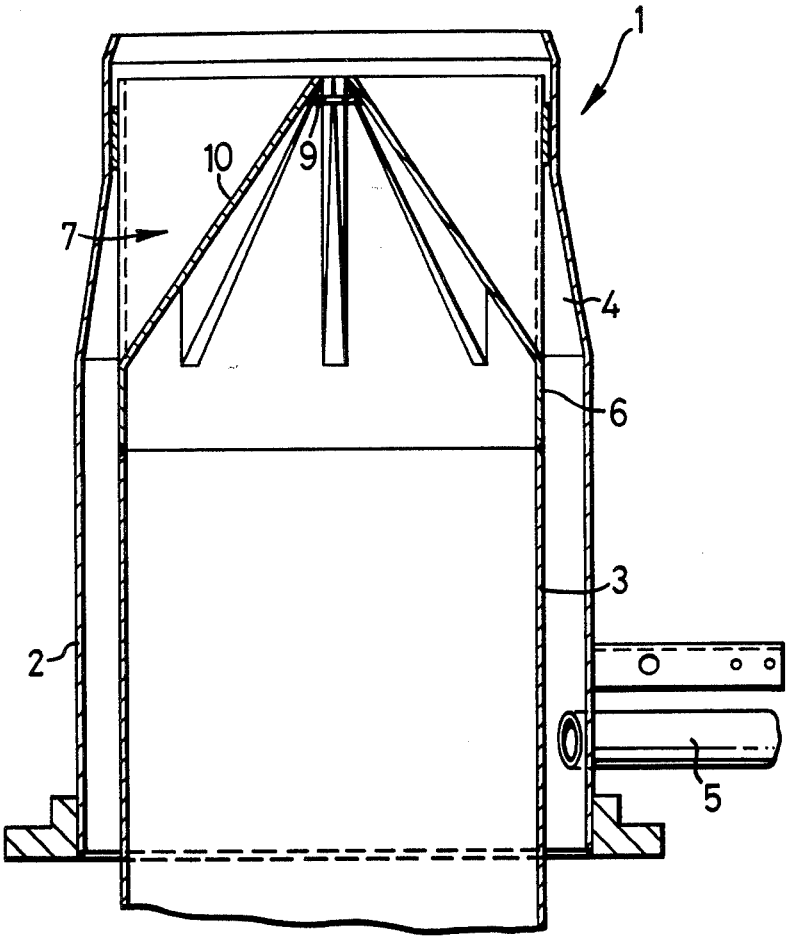
FIG. 1 is a vertical section through the flarestack showing the location of the mixing head.

A flarestack indicated generally by numeral 1 comprises an outer tube or jacket 2 and a co-axial inner tube 3 spaced apart to form an annular passage 4. The tubes are fabricated from steel. This annular passage is connected by tube 5 to a source of fuel gas. The inner tube passes down to near the base of the flarestack and is connected to a pressurised air source supplied by a fan. At the gas/air outlet end of the flarestack, there is provided a mixing head 6 which serves to promote the mixing of fuel gas and air. The top of the outer tube 2 is turned inwards to deflect the fuel gas flow inwardly towards the air issuing from the outlet of the inner tube.

This improves gas/air mixing at lower fuel gas velocities.

Figure 2:
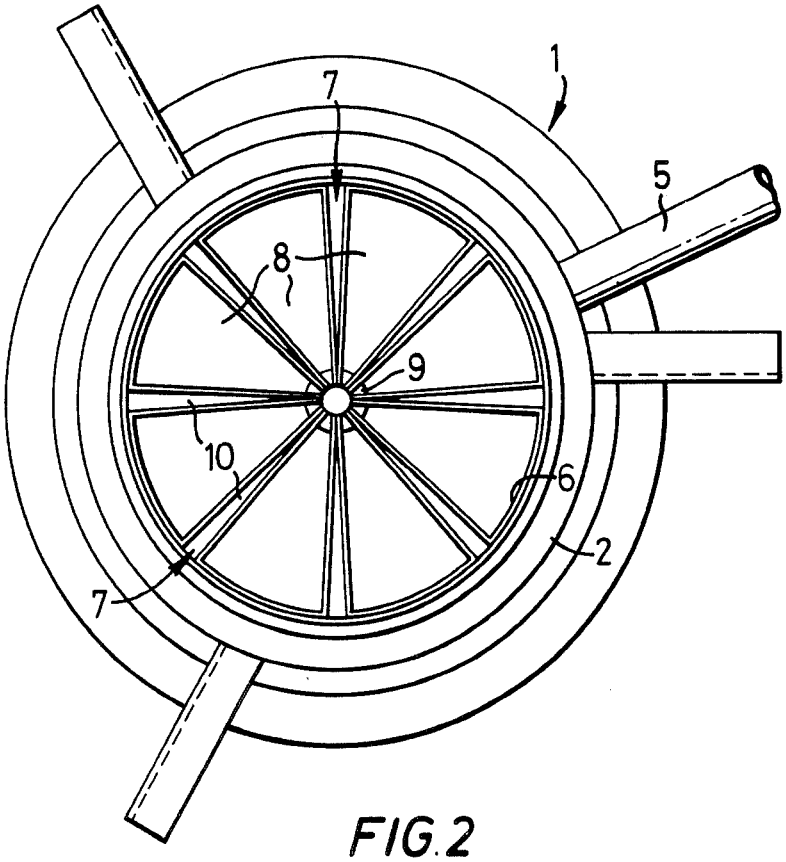
FIG. 2 is a plan view of the outlet of the flare showing the location of the gas exits.
Figure 3:
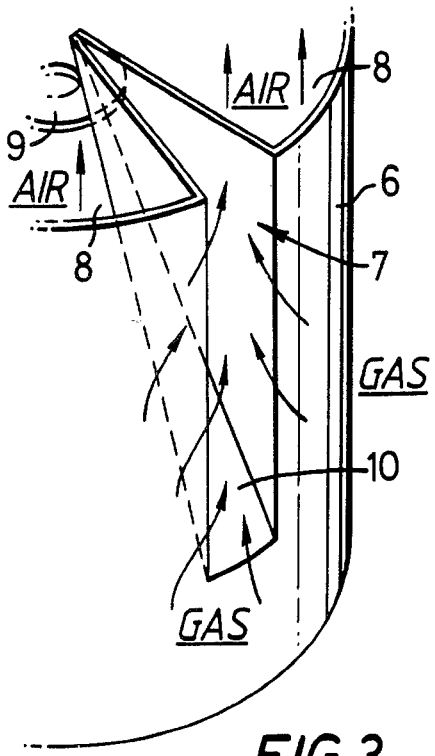
FIG. 3 is an isometric view of one of the gas outlet intrusions.

The mixing head 6 comprises eight radial channels or intrusions 7 in the inner tube 3. The intrusions 7 are arranged symmetrically around the periphery of tube 3 and increase in depth (radially) from channels or intrusions of the mixing head. The air duct exit is formed from eight equally spaced triangular cross-section areas 8 lying between each intrusion 7 and a small central circular cross-section portion 9. The gas duct exit is formed from an annular region between the inner and outer tubes 2,3 and the narrow triangular cross-section portion 10 formed by the intrusion 7 in the wall of the inner tube 3. These areas are shown in FIG. 2.

During use of the flare, fuel gas is supplied to the annular gap between the inner and outer tubes 2,3 and combustion air is supplied to the air duct inner tube 3 by means of a motor driven fan (not shown). The fuel gas emerges from the triangular cross-section outlets 10 of the intrusions 7 and the annular passage 4 and mixes with the air emerging from the eight equally spaced outlets 8 and the central outlet 9, the mixing being encouraged by the inward and upward component of gas flow caused by passage along the intrusions 7. The resultant combustible mixture is ignited and burned at the flare outlet. A pilot light or lights (not shown) are mounted close to the flare outlet and may be used to ignite the combustible gas mixtures.

A 36 inch diameter flare was tested with a fuel gas of approximate molecular weight of 36 and having a flow rate of 10.5 tons per hour at a pressure of up to 4 inches water gauge. The inner tube had an internal diameter of 30 inches and the annular gap width was about $\frac{3}{4}$ inch. The equally spaced intrusions or channels had a longitudinal axial length of 18.8 inches, a radial depth of 14 inches and a width of 1.3 inches. The total cross-sectional area of the intrusions was about equal to the total cross-sectional area of the annular gap (0.0465 meters$^2$ or 0.5 foot$^2$). During the period of running the flame was stable and had reduced or no smoking tendency and excessive flare metal temperatures were absent.

I claim:

1. A flare tip comprising:

(a) an upwardly extending air supply tube for delivery of combustion air to the flare tip, (b) an outer fuel supply tube co-axial with and spaced apart from said upwardly extending air supply tube to form an annular chamber having a fuel gas outlet capable of supplying low pressure combustible fuel gas to the flare tip, said annular chamber being longer than it is wide and extending co-axially substantially the length of the air supply tube, (c) the upper part of the air supply tube comprising a plurality of channels or intrusions formed of equally spaced hollow projections from the inner surface of the air supply tube arranged symmetrically around the periphery, and equally spaced triangular cross-section combustion air outlet ducts lying between each intrusion, with upward and inward flow of fuel gas caused by passage along the intrusions encouraging mixing with the combustion air exiting the equally spaced outlet ducts, (d) the upper part of the annular chamber having a circumferential deflector adapted to direct low pressure fuel gas inwardly towards the air issuing from the outlet of the air supply tube, said circumferential deflector being formed by the top of the outer fuel supply tube being turned inwards.

2. A flare tip according to claim 1 in which the shape of the channels is aerodynamically contoured to give minimum resistance to upward and inward gas flow.

3. A flare tip according to claim 1 in which the total cross-sectional area of the channel outlets is greater than or equal to the total cross sectional area of the annular fuel gas outlet.

* * * * *